United States Patent [19]

Hardesty

[11] 4,054,350

[45] Oct. 18, 1977

[54] MODULAR PLUG FOR TERMINATING CORD HAVING NON-PLANAR ARRAY OF CONDUCTORS

[75] Inventor: Edwin Charles Hardesty, Perry Hall, Md.

[73] Assignee: Western Electric Company, Inc., New York, N.Y.

[21] Appl. No.: 747,456

[22] Filed: Dec. 3, 1976

[51] Int. Cl.[2] ..... H01R 13/38

[52] U.S. Cl. ..... 339/99 R; 339/103 M

[58] Field of Search ..... 339/97–99, 339/103

[56] References Cited

U.S. PATENT DOCUMENTS

| | | | |
|---|---|---|---|
| 3,699,498 | 10/1972 | Hardesty et al. | 339/99 R |
| 3,761,869 | 9/1973 | Hardesty et al. | 339/99 |
| 3,768,067 | 10/1973 | Rault | 339/99 R |
| 3,812,449 | 5/1974 | Elm | 339/99 |
| 3,850,497 | 11/1974 | Krumreich et al. | 339/98 |
| 3,860,316 | 1/1975 | Hardesty | 339/103 M |
| 3,890,029 | 6/1975 | Izraeli | 339/126 |
| 3,998,514 | 12/1976 | Hardesty | 339/98 |
| 4,002,392 | 1/1977 | Hardesty | 339/99 |

*Primary Examiner*—Joseph H. McGlynn

*Attorney, Agent, or Firm*—E. W. Somers

[57] ABSTRACT

A modular plug especially suited for terminating electrical cords in which the conductors are disposed in a generally non-planar array includes a plastic housing with at least two tiers of conductor-receiving cells and a plurality of terminal-receiving openings associated with the cells. Each opening includes a slot extending parallel to and communicating with the associated cell. The length of each slot is exposed to an exterior surface of the housing. A terminal is inserted partially into each opening with portions of the housing which define the opening being in compressive engagement with edge surfaces of the terminal to support the terminal against unintended movement. An assembler removes a plastic jacket from an end portion of a cord and inserts each insulated conductor into a predetermined one of the cells. Then the assembler actuates a tool to anchor the plug to the cord and to sever excess lengths of the conductors. The terminals that had been partially inserted into the housing are driven into a fully seated position with internal contact portions thereof in engagement with the conductors and with externally exposed edge surfaces presented in a single plane and adapted to be engaged by electrical components of telephone apparatus into which the plug is destined to be inserted.

20 Claims, 15 Drawing Figures

MODULAR PLUG FOR TERMINATING CORD HAVING NON-PLANAR ARRAY OF CONDUCTORS

BACKGROUND OF INVENTION

1. Field of the Invention

This invention relates to a modular plug for terminating a cord having a non-planar array of conductors, and more particularly, to a plug that is specially suited to terminating a telephone cord having a generally circularly configured cross-section to facilitate connection of the cord to modular jacks in communications equipment.

2. Prior Art

Telephone cords which connect a telephone base to a telephone handset and the base to a wall terminal are known. These cords typically include a plurality of individually insulated electrical conductors and a plastic jacket enclosing the conductors. In the past, telephone cords were constructed with a cross-section of the cord being circularly configured and were terminated with flat connectors referred to as spade tips. See, for example, U.S. Pat. No. 2,609,417 issued Sept. 2, 1952 in the name of T. K. Cox et al.

The connection of spade-tip terminated cords to telephone apparatus and to wall terminals is accomplished by installers. Hence, the cost of changing such cords and installing telephones equipped with such cords must include charges for services performed by the installers at the customer's premises.

In order to expedite the replacement of telephone cords or the installation of telephone apparatus which in a growing number of areas are available at PhoneCenter stores, a "modular" system of telephone set components has been introduced. This system employs wall terminals and telephone apparatus with jacks which are adapted to receive modular plugs. Modular plugs and jacks are shown, for example, in U.S. Pat. Nos. 3,699,498 and 3,761,869 issued Oct. 17, 1972 and Sept. 25, 1973, respectively, both in the names of E. C. Hardesty, C. L. Krumreich, A. E. Mulbarger, Jr. and S. W. Walden, both of which are incorporated by reference hereinto. Telephone cords, both straight and retractile, are now terminated with modular plugs which preferably provide a side-by-side array of conductors, with terminals being aligned longitudinally with the axes of the conductors.

Modular plugs are designed to permit a subscriber to insert a plug into a jack and/or to remove the plug from the jack. This provides the customer with the capability of changing cords and/or installing additional telephones with existing wall terminals. Because of the ease with which telephone handsets may be connected to and disconnected from wall terminals, the handsets become portable. Still further, the customer may disconnect a retractile cord to remove kinks and then reconnect the cord.

The system of modularity also employs cordage with individually insulated conductors arranged in a side-by-side planar array. Such an arrangement, referred to as a "flat" cord, facilitates the assembly of a plug to a cord since an assembler need not orient the conductors individually prior to assembly with the plug. Also, "flat" cord insulated conductors are substantially smaller in diameter than insulated conductors used to construct the priorly manufactured circularly configured cords.

When refurbishing priorly made circularly configured cords, there has been a desire to terminate the refurbished cord with modular plugs. However, the plug which is being used to terminate the "flat" cords and shown for example, in U.S. Pat. No. 3,860,316, issued Jan. 14, 1975 in the name of E. C. Hardesty, and incorporated by reference hereinto, is not adapted to be assembled to cords having a non-planar array of conductors as is typical of the prior style cords. This incompatibility exists because the conductors of the prior style cord are considerably larger than those of the "flat" cord. A side-by-side arrangement is not possible if the spacing of the terminals which connect the conductors to components in the jack is maintained.

It is an object of this invention to provide modular plugs specially suited to terminating telephone cords having a generally circular configuration.

A further object is to provide a plug for terminating circularly configured cords and having provisions for supporting securely the terminals in an armed position with contact portions of the terminals spaced above the cord conductors for shipment to the field, whereupon the terminals may be driven into a fully seated position in engagement with cord conductors after a cord end has been inserted into the plug.

Connectors in which terminals are preassembled and partially seated in a housing transversely of a side-by-side array of conductors are shown in U.S. Pat. Nos. 3,812,449 and 3,890,029. Modular plugs which are armed with terminals for terminating "flat" cords are disclosed in application Ser. No. 620,629 filed Oct. 6, 1975 in the name of E. C. Hardesty, all of which are incorporated by reference hereinto, and commonly assigned.

SUMMARY OF THE INVENTION

An electrical connecting device for terminating a cord having the conductors thereof disposed in a non-planar array includes a housing made of a dielectric material and having a free end and a cord-input end. The cord-input end opens to a cavity which communicates with a plurality of conductor-receiving cells arranged in at least two tiers. Each of the cells communicates through a slot of a terminal-receiving opening to an outwardly facing surface of the housing. A terminal is seated within each of the openings and has an internal contact portion extending into the associated cell to pierce the insulation of and make electrical engagement with the conductor therein. Each terminal also has an external contact portion for making electrical engagement with a component external to the housing. Further each terminal has oppositely disposed edge surfaces in compressive engagement with walls of the housing which define the associated terminal-receiving opening to support the terminal against unintended movement.

Advantageously, each terminal may be inserted partially into the associated terminal-receiving opening in an interference fit with walls which define the opening with the internal contact portions spaced above the associated cell to permit insertion of one of the conductors therein. The housing armed with the terminals is moved to another work center when a jacket is removed from a cord end and the conductors inserted into the cells. Then the terminals are caused to assume a final position with the internal contact portions engaging the conductors and with the external contact portions disposed in a single plane adjacent to the outwardly facing surface of the plug for engagement with a component of a jack into which the plug is later inserted.

BRIEF DESCRIPTION OF THE DRAWINGS

Other objects and features of the present invention will be more readily understood from the following detailed description of preferred embodiments thereof when read in conjunction with the accompanying drawings, in which.

DETAILED DESCRIPTION

The phrase "modular cord system" is intended to describe a system which includes the use of devices mounted in equipment and assembled to ends of cords to permit customer connection of the cords to the equipment. The economic advantages of modular systems together with the convenience afforded the customer have resulted in widespread acceptance of such systems.

Figure 1:
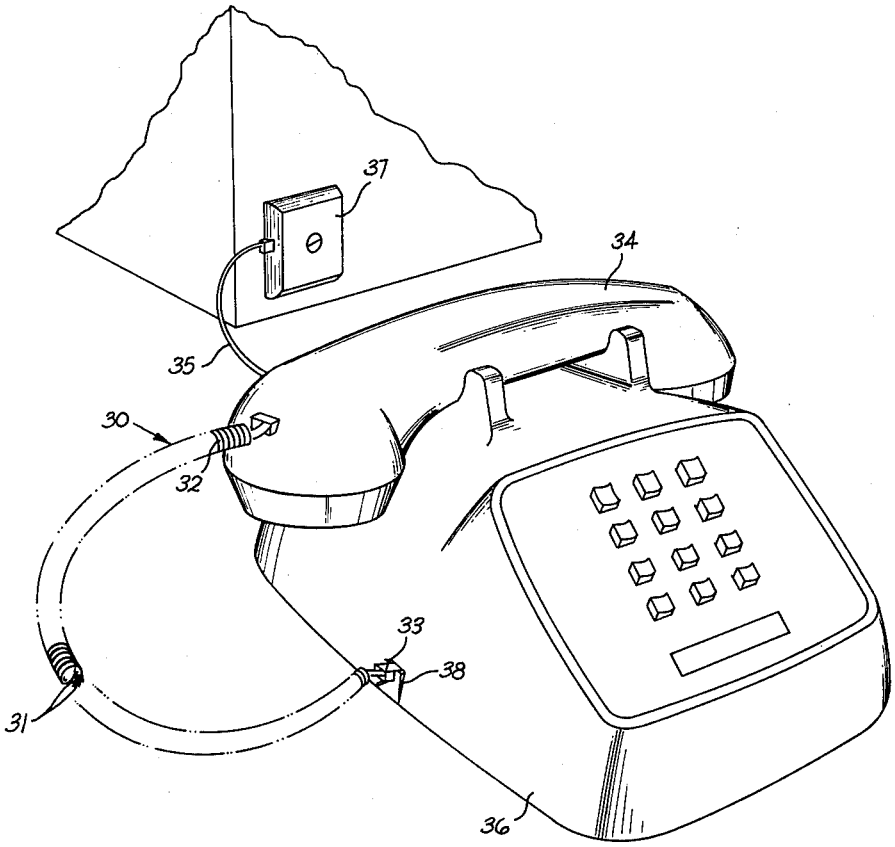
FIG. 1 is a perspective view of a telephone set having a base and handset thereof connected by a retractile cord which has been terminated with modular plugs, and showing the base connected to a wall terminal by a line cord which also has been terminated with modular plugs.
Figure 2:
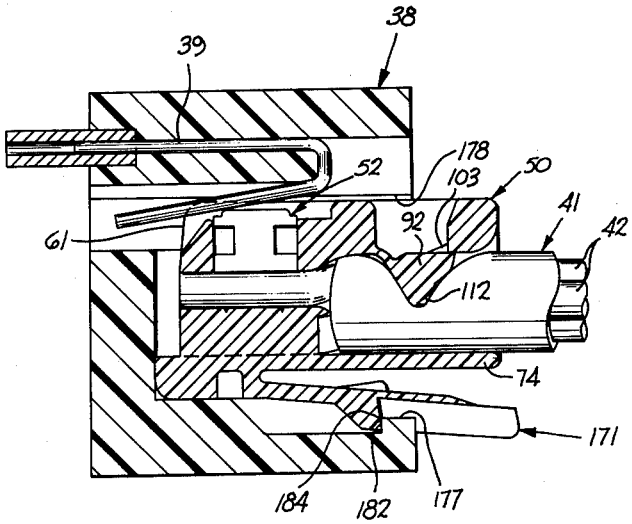
FIG. 2 is an enlarged elevational view in section showing a modular plug, which embodies the principles of this invention, inserted into a jack of a telephone set to connect a cord having conductors arranged in a non-planar array with components in the jack.

Modular cord systems typically include retractile cords 30-30 and line cords 35-35 (see FIG. 1) each having a plurality of individually insulated tinsel conductors 31-31 and terminated with modular plugs 33-33. The plurality of insulated conductors 31-31 are preferably disposed side-by-side in a planar array and are enclosed in a common jacket with the final configuration having a cross-section with parallel sides and semicircular ends, and being referred to as a "flat cord". The flat cords are terminated typically with modular plugs of the type shown, for example, in priorly identified U.S. Pat. No. 3,860,316 and incorporated by reference hereinto. The cord 30 is connected from a telephone handset 34 to a base 36 or the cord 35 is connected from the base 36 to a wall terminal 37 by inserting the plug 33 into a jack 38 (see also FIG. 2) mounted therein. The jack 38 includes a plurality of wire-like contact elements 39-39 which may be spaced on 0.040 inch centers and is typically that shown in priorly identified U.S. Pat. No. 3,780,316.

Figure 3:
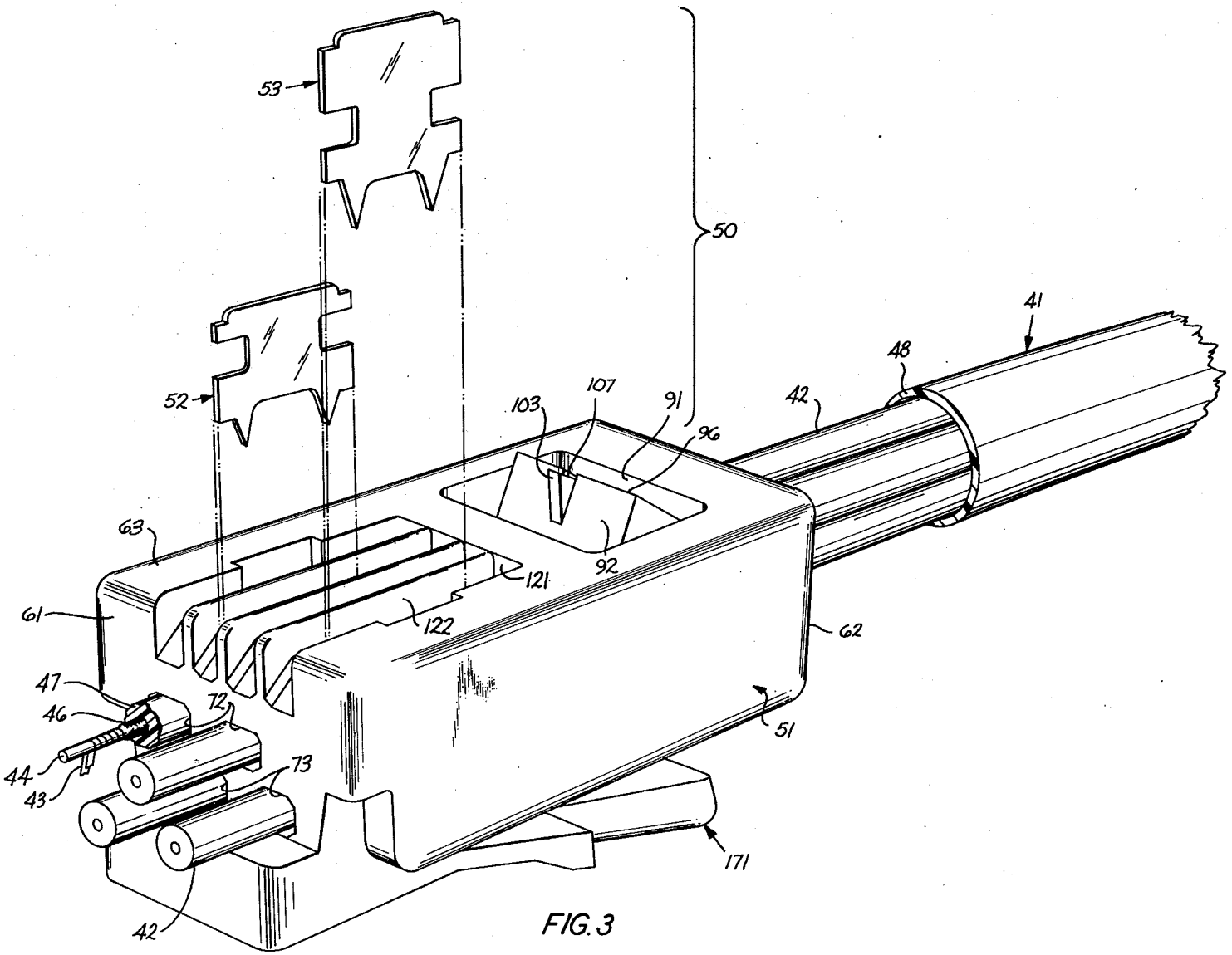
FIG. 3 is an enlarged perspective view of one of the plugs of FIG. 2 comprising an unipartite housing with the cord inserted partially thereinto but prior to assembly of terminals therewith and showing an internally movable jacket strain relief member in an unoperated position.

Telephone cords were not always manufactured with the conductors in a planar array. For example, a priorly manufactured circular cord 41 (see FIGS. 2 and 3) includes a plurality of individual conductors 42-42. Each conductor 42 includes a plurality of tinsel ribbons 43-43 wrapped helically about a filamentary core 44 with the resulting assembly enclosed in a textile braid or nylon knit barrier 46. A plastic insulation 47, typically polyvinyl chloride, is extruded over the barrier 46, and a plurality of the individually insulated conductors 42-42 are enclosed with a plastic jacket 48. These cords 41-41 were referred to as "round" cords and are shown, for example, in priorly identified U.S. Pat. No. 2,609,417, incorporated by reference hereinto. The conductors 42-42 typically have been terminated with spade-tip connectors such as shown, for example, in U.S. Pat. No. 2,920,351 issued Jan. 12, 1960 in the name of E. C. Hardesty et al.

Cords 41-41 of this letter described circular cross-section configuration are frequently returned to processing centers where they are refurbished for reuse in customer premises. This invention is directed to providing plugs 50-50 (see FIG. 3) for terminating refurbished "round" cords 41-41 to enable the reuse of the cords as compatible parts of modular systems.

The provision of the plugs 50-50 which permit assimilating "round" cords 41-41 into modular systems is not without problems. The conductors 42-42 are generally substantially larger than the conductors of the new flat cords, i.e. 0.058 inch as opposed to 0.039 inch. However, the cords 41-41 and the conductors 42-42 must be accommodated within the framework of a plug 50 having fixed outside dimensions to permit insertion into one of the jacks 38-38.

An electrical connection must be established between the cord conductors 42-42 and the apparatus in which the jack 38 is mounted. This is readily accomplished when using the "flat" cords in which the conductors 31-31 have substantially the same spacing as the contact wires 39-39. The plugs used to terminate "flat" cords are provided with terminals which have the same spacing as the cord conductors, and hence, the same spacing as the contact wires 39-39. This is not true with the "round" cord 41 in which the conductors 42-42 are disposed in a non-planar array. Moreover, variations exist in dimensions and configurations of the conductors 42-42 in the "round" cords 41-41.

The modular plug 50 constructed in accordance with the principles of this invention includes a housing 51 (see FIG. 3) which is made from a dielectric material and a plurality of terminals 52-52 and 53-53. The terminals 52-52 and 53-53 provide the electrical connection between the conductors 42-42 of the cord 41 end held within the plug 50 and electrical components in telephone apparatus, e.g. the wire-like contact members 39-39 of the jack 38, to which the cord is to be connected.

Further, the plug 50 constructed in accordance with this invention is manufacturable with the terminals 52-52 and 53-53 inserted partially into the housing. The plug 50 armed with the terminals 52-52 and 53-53 partially inserted thereinto is shipped to field locations for assembly to ends of refurbished cords 41-41. After a cord end is assembled to a plug 50, an assembler seats the terminals 52-52 and 53-53 completely in the plug.

The invention will be described first by considering the plug housing 51 and the terminals 52-52 and 53-53 in an order which follows the assembly process. Portions of the housing 51 and the terminals 52-52 and 53-53 are described with reference to priorly identified U.S. Pat. No. 3,860,316 and to application Ser. Nos. 620,629 and 620,630, filed Oct. 6, 1975 in the name of E. C. Hardesty, both applications also being incorporated by reference hereinto, and commonly assigned.

The plug housing 51 is an unipartite rigid housing, (see FIGS. 3 and 4), which is designed to be constructed from a plastic material, by using conventional injection molding techniques. The plastic material must provide suitable mechanical strength as well as adequate electrical insulation and may be comprised, for example, of a polycarbonate, a polyester, a polyamide, or related polymer materials such as ABS resins. The housing 51 has a free end 61, a cord-input end 62 and a terminal-receiving side 63.

Figure 4:
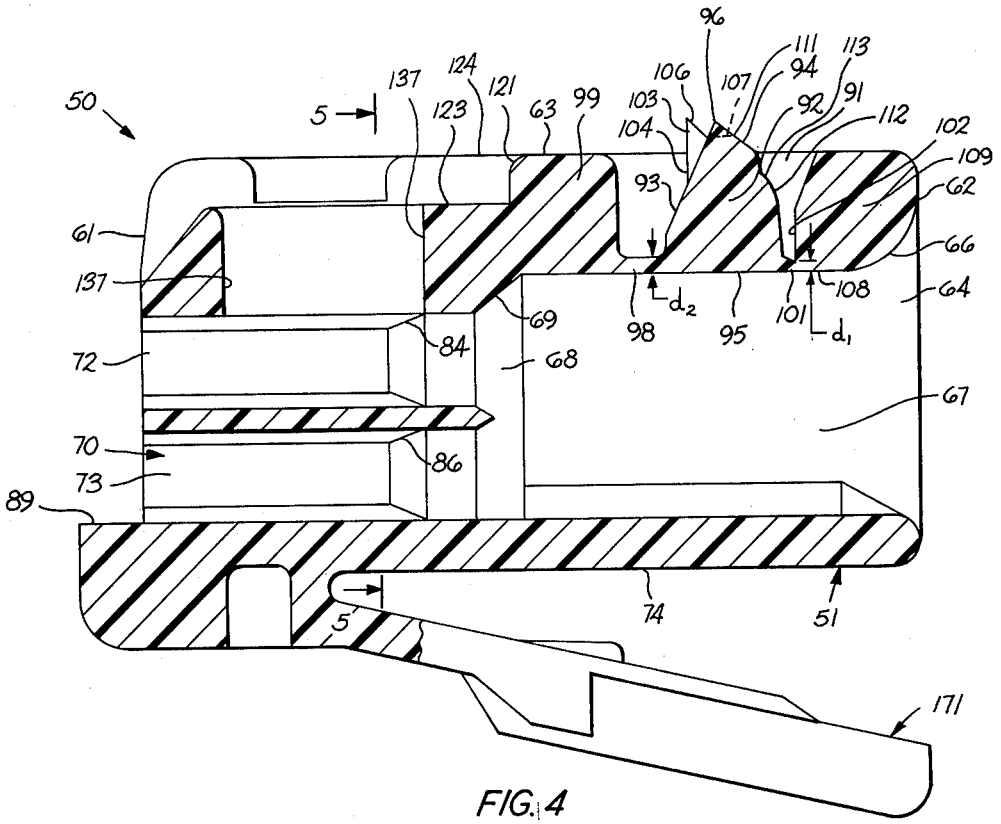
FIG. 4 is an elevational view of the housing of FIG. 3 prior to the cord and terminals being inserted.

As may be observed from FIG. 4, the cord-input end 62 of the housing 60 is formed with a cord-input aperture 64 which is designed to circumscribe generally the outer periphery of the largest cord 41 expected to be terminated with the plug 50. The unipartite housing 51 is constructed in one-piece with no hinging or bonding of sub-parts required and with the aperture 64 formed entirely therewithin. The aperture 64 has a flared entrance 66 which prevents, advantageously, sharp bends in the cord 41 during customer use. The flared entrance 66 also facilitates insertion of an end portion of the cord 41 after ones of the conductors 42-42 have been inserted.

The aperture 64 opens to a cavity 67 which terminates adjacent a transition section 68. The transition section 68 includes a wall 69 which is tapered along the top and sides, as viewed in FIG. 4, to connect the cavity 67 to a conductor-receiving portion, designated generally by the numeral 70, of the plug 50.

The conductor-receiving portion 70 of the housing 51 is constructed to provide a plurality of individual compartments or cells 72-72 and 73-73, in upper and lower tiers, respectively, (see FIGS. 4 and 5) for receiving the conductors 42-42 of a cord 41. The cells 72-72 and 73-73 are of sufficient size to accept the largest cross-sectional size conductor 42 expected to be encountered in a refurbishing center. Since the conductor cross-section is generally slightly smaller than the cross-section of the cell 72 or 73 an assembler can easily insert the conductors 42-42 into the cells. The cross-sectional configuration of the cells 72-72 and 73-73 is designed to be capable of accommodating irregularly-shaped cross-section conductors 42-42.

Further, the cells 72-72 and 73-73 are constructed to prevent a dielectric breakdown between adjacent conductors 42-42 and terminals 52 and 53. A dielectric breakdown may result from the ingress of moisture or other corrosive contaminants. A dielectric breakdown may also result because of shortened dielectric paths between adjacent conductors and/or terminals caused, for example, by the terminals 52 or 53 engaging the associated conductors 42-42 to either side of the centerlines of the conductors.

Figure 5:
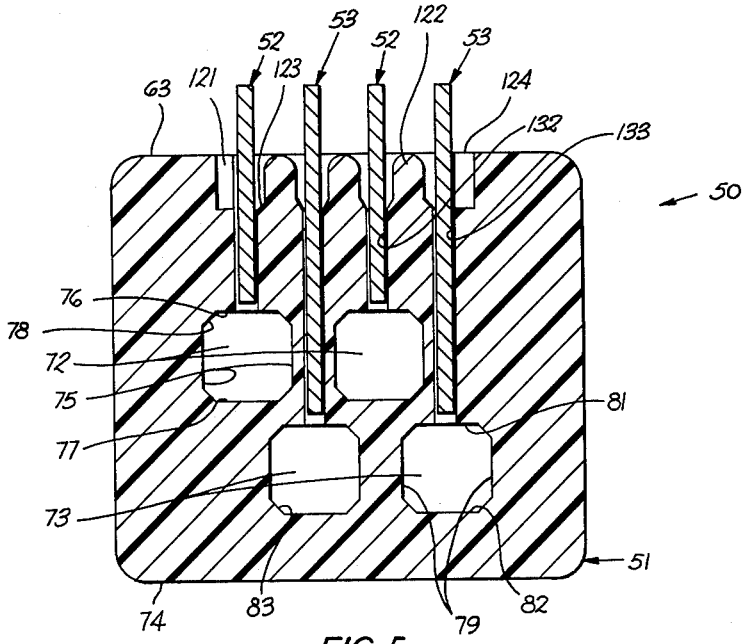
FIG. 5 is a sectional view of the housing of FIG. 4 taken along lines 5—5 thereof with terminals partially inserted thereinto.

As can best be seen in FIGS. 4 and 5, the cells 72-72 and 73-73 extend longitudinally of the housing 51 from the transition section 68 to the free end 61. The cells 72-72 and 73-73 are arranged with the cells 72-72 being disposed in a first tier which is adjacent the terminal-receiving side 63. The cells 73-73 are disposed in a second tier which is adjacent a side 74 of the housing 51 opposite to the terminal-receiving side 63.

Each of the cells 72-72 is enclosed laterally throughout the length thereof and may have a generally square cross-sectional configuration formed by opposing walls 75-75, and opposing walls 76 and 77 (see FIG. 5). The orthogonal intersection of each two adjacent walls which define each cell is replaced with a bevel surface 78. Similarly, each cell 73 is formed by side walls 79-79 and opposing walls 81 and 82. The line intersections of these walls is replaced with beveled surfaces 83-83.

The entrance to each cell 72 and 73 which is oriented toward the cord input end 62 of the housing is chamfered along four surfaces 84 and 86 respectively. The chamfering of the entrance portion of the cells 72 and 73 facilitates the insertion of the conductors 42-42.

Modular plugs used with flat cords typically are formed with conductor-receiving troughs having an approximate width of 0.040 inch. Typically, each of the cells 72 and 73 is approximately 0.057 inch in width and in height. The increased size is necessary in order to accommodate the enlarged insulated conductors 42-42 of the priorly made cords 41. Since ones of the plugs 50-50 will be used with cords 41-41 having conductors 42-42 which are smaller than the largest expected size, the terminals 52 and 53 must be supported in alignment with the centerline of the cells 72 and 73. The support must be sufficient to prevent unintended movement of the terminals 52 and 53. This assures that the subsequent seating of the terminals 52 and 53 completely within the housing 51 will cause the terminals to engage the conductive portion of the conductors 42-42 notwithstanding a somewhat loose fit of the conductors in the cells.

The generally square configuration of the cells 72 and 73 is advantageous not only during molding in aligning slot-forming core blades with cell core pins, in providing excellent dielectric breakdown protection, and in accommodating irregularly shaped, i.e. out-of-round conductors, but also in implementing the final seating of the terminals 52 and 53. Surfaces 77 and 82 of the cells 72 and 73, respectively, are flat to provide a bearing surface against which the terminals 52 and 53, respectively, will be driven. In some prior art plugs in which V-shaped bearing surfaces are used, the terminals may be canted slightly and be spaced from the apex of the surfaces which define the V. This caused, disadvantageously, the height of the exposed external contact edge surface of the terminals to vary.

Figure 6:
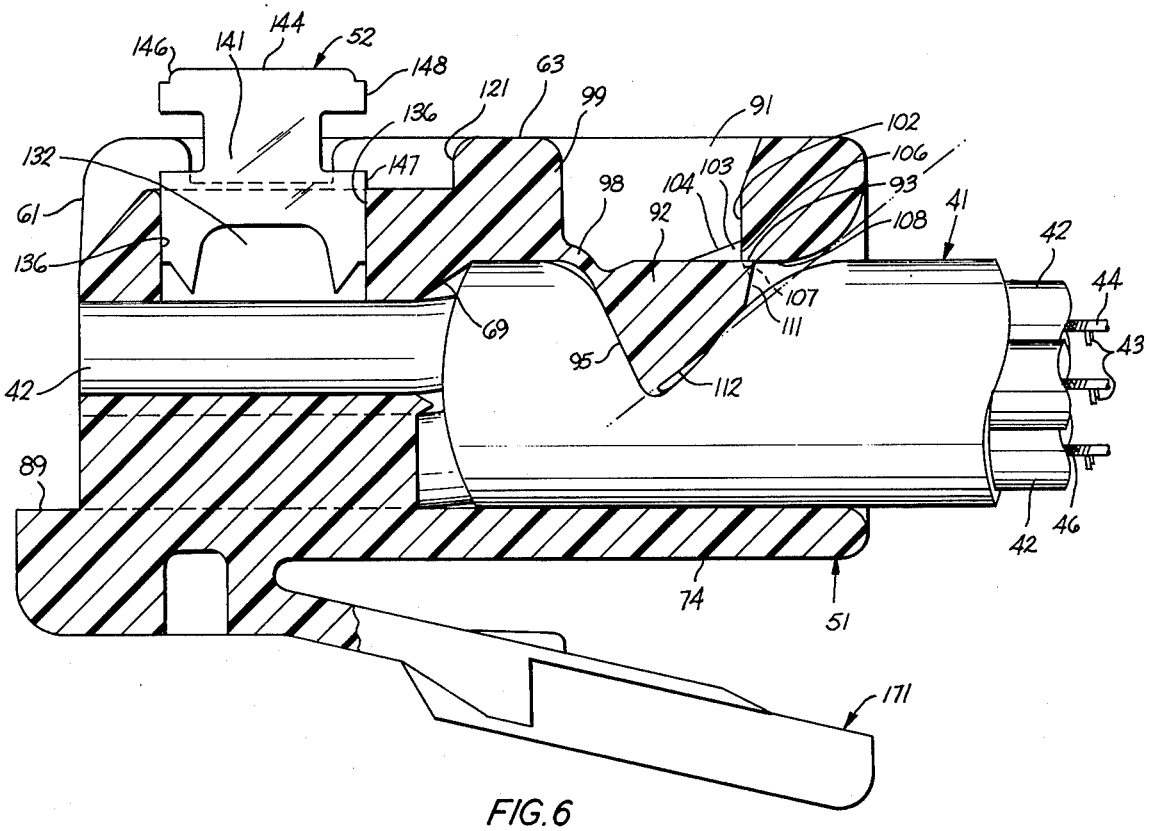
FIG. 6 is an enlarged elevational view in section of the plug showing one of the terminals inserted partially, with a cord end inserted and with the strain relief member actuated to lock the plug to the cord.

The cells 72 and 73 open to the free end 61 of the housing 51 to facilitate conductor cut-off. An assembler removes a sufficient length of jacket 48 to permit insertion of the conductors 42-42 into predetermined ones of the cells 72 and 73 with the jacketed portion of the cord 41 being outside the housing 51 (see FIG. 3). Then, the assembler inserts the jacketed portion of the cord 41 to abut the beveled surface 69 of the transition section 68 (see FIG. 6), with the conductors 42-42 extending farther past the free end 61 of the housing 50. A ledge 89 (see FIGS. 4, 6 and 7) acts to provide support for the conductors 42-42 in the cells 73-73 during the cut-off operation. Tooling (not shown) of a type commercially available is operated to sever the excess lengths of the conductors 42-42 protruding from the free end 61 of the housing 51.

The housing 51 is also constructed with jacket strain-relief facilities which are actuated after the leading end portion of the jacketed cord 41 is inserted into the cavity 67. These facilities, which contribute to the feasibility of the unipartite, as opposed to a two piece, housing 51, are disclosed in priorly identified and commonly assigned application Ser. No. 620,630.

The strain-relief facilities are disposed within an opening 91 (see FIGS. 3 and 4), which may open to the terminal-receiving side 63 of the housing 51. A jacket-anchoring member 92 is disposed within the opening 91 and includes surfaces 93 and 94 which intersect along an edge 96. The anchoring member 92 extends generally across the width of the opening 91. Further, the anchoring member 92 includes a surface 95 which faces into the cavity 67.

The anchoring member 92 is connected to the housing 51 through a plastic hinge 98 oriented toward the free end 62 of the housing and extending from a wall 99. At its other end, the anchoring member 92 is connected temporarily to the cord-input end 62 of the housing 51 through a fragile web 101. The web 101 supports the anchoring member 92 in the as-manufactured, unoperated position as shown in FIG. 4 to permit insertion of the end portion of the cord 41 into the cavity 67.

The web 101 is constructed with the dimension "$d_1$" adjacent a wall 102 substantially less than the dimension"$d_1$" of the hinge 98 adjacent the wall 99. This controls the separation of the anchoring member 92 from the housing 51 to be adjacent the wall 102 as opposed to the wall 99.

Moreover, the web 101 is tapered with the thickest portion being adjacent the anchoring member 92 rather than the wall 102. This insures that the separation occurs advantageously as close to the wall 102 as possible thereby causing the web 101 to remain attached to the anchoring member 92. When the anchoring member 92 is moved into engagement with the jacket 48, the web 101 forms a rounded portion to engage the contour of the cord (see FIG. 6). But for the web 101, a sharp edge of the anchoring member 92 formed by intersecting surfaces 94 and 95 would bite into the jacket 48 and possibly cause tearing of the jacket during customer use.

The surface 93 of the anchoring member 92 is molded to include a stop 103 disposed centrally thereof. The stop 103 includes two surfaces 104 and 106. A portion 107 of the edge 96 of the anchoring member 92 is discontinuous and is chamfered along a portion thereof which is aligned with the stop 103.

An assembler applies forces to the anchoring member 92 to break the web 101 and to move the anchoring member about its plastic hinge 98. The anchoring member 92 adjacent the edge portion 107 of the anchoring member is compressed as it is moved along a portion of the wall 102. As the edge 96 passes beyond a surface 108, the elastic memory properties of the anchoring member 92 facilitate spring-back toward its initial configuration with a portion of the surface 93, i.e. about 0.008 inch, snap-locking under the surface 108 (see FIG. 6).

In the actuated position, the surface 106 of the stop 103 engages the wall 102 which defines in part the portion 109 of the housing adjacent the flared entrance 66. This surface engagement cooperates with the portion of the surface 93 snap-locking under the surface 108 to maintain the anchoring member 92 in locked engagement with the cord 41 and the housing 51. This arrangement causes the jacket strain-relief capabilities of the plug 50 to continue to be effective during customer use when retrograde forces may be applied to the cord 41. The engagement of the step 103 with the wall 102 controls the pivotal movement of the anchoring member 92 by preventing overtravel of the anchoring member and thereby prevents excessive stressing and possible damaging of the cord 41 and the plastic housing 51.

The general surface 94 of the anchoring member 92 is formed with two surfaces 111 and 112 connected by a step 113. When the anchoring member 92 is moved to an actuated position, the surface 112 is aligned with a tangent to a portion of the cord-input aperture 64 (see FIG. 6). This provides continuous support of the cord 41 between the anchoring member 92 and the flared entrance 66. This minimizes, advantageously, flexing of the cord 41 in the vicinity of the anchoring member 92.

Unipartite modular plugs of the type shown, for example, in U.S. Pat. No. 3,860,316 include conductor strain-relief facilities as well as jacket strain-relief facilities of the type just described. However, because of the knit barrier strength member 46 in the priorly made circularly configured cords 41-41 which are destined to be terminated with plugs 50 of this invention, conductor-restraining facilities are not required.

The housing 51 includes facilities for mounting a plurality of the terminals 52 and 53. The housing 51 is constructed with a well 121 opening to the surface 63 (see FIGS. 3, 4 and 5). The well 121 has a plurality of spaced, longitudinally extending fins 122-122 which project from an inner surface 123 of the well 121 toward a plane 124 of the terminal-receiving side 63. The fins 122-122 are spaced apart on 0.040 inch centers in order to correspond to the spacing of wire-like contact members 39-39 of the jack 38. When a plug 50 is inserted into a jack 38, each wire-like contact member 39 is received between two adjacent ones of the fins 122-122.

The conductor-receiving cells 72 and 73 and the associated terminal-receiving facilities must be constructed within certain restrictions consistent with the dimensions of the associated jacks 38-38 and cords 41-41. The 0.040 inch spacing of the external contact elements 39-39 and the size of the jack 38 into which the plug 50 is inserted are standard dimensions. The external dimension of the insulated conductors 42-42 is fixed. Since the cells 72 and 73 are designed to accommodate the enlarged conductors 42-42, and since the lateral spacing of the conductors must be the same as with the "flat" cord in order to be aligned with the openings between the fins 122-122, the conductors 42-42 can not be disposed in a planar array.

The housing 51 includes a plurality of terminal-receiving openings 132 and 133 (see FIGS. 6-7) each of which includes a slot opening to the surface 123 and connecting the well 121 with the cells 72 and 73, respectively. The terminal-receiving openings 132 and 133 extend parallel to the cells 72 and 73 and include end walls 136-136 and 137-137, respectively.

The terminal 52 which is made from an electrically conductive material such as, for example, brass or Phosphor-bronze (see FIG. 8A) will be described in detail and it will be understood that corresponding portions of the terminal 53 (see FIG. 8B) are designated with the same numerals but with a prime superscript. The terminal 52 has flat faces 141-141 spaced apart by an edge surface 142 from which conductor-engaging portions, also referred to as internal contact portions, in the form of tangs 143-143 protrude. When the terminals 52 and 53 are seated fully within the housing 51, the tangs 143-143 pierce or puncture the conductors 42-42 to engage the tinsel ribbons 43-43 and establish electrical contact.

The terminals include external contact portions, exposed to an outer surface of the plug 50. The wire-like members 39-39 in the jacks 38 (see FIG. 2) engage the external contact portions of the terminals to complete the electrical path from the conductors 42-42 to the external components. Each terminal 52 has an external contact portion in the form of an edge surface 144 having crowns 146-146 of predetermined radii formed at the ends thereof. The crown 146 adjacent the free end 61 of the housing 51 functions to engage the aligned wire-like component 39 of the jack 38 into which the plug 50 is inserted.

Since the width of each terminal-receiving opening 132 and 133 is about 0.014 inch while each of the terminals 52 and 53 is made from 0.012 inch thick sheet stock, there is insufficient proximity between the flat faces thereof and the side walls of the terminal-receiving openings to support the terminals in the temporary position without risking undesired canting of the terminals. Connectors armed with canted terminals are troublesome to field personnel who assemble the connectors to cords 41-41.

The terminals-receiving openings 132 and 133 are dimensioned lengthwise between the end walls 136-136 and 137-137, respectively, to provide an interference fit with the terminals 52 and 53 received therein. In order to provide the interference fit, each terminal 52 and 53 has an overall length of about 0.134 inch while each terminal-receiving opening has an overall length of about 0.125 inch. This arrangement provides advantageously a continuous end support surface of the terminals and is especially helpful in providing a plug 50 armed with the terminals in temporary, properly aligned positions for shipment to field users.

The terminals 52 and 53 must be configured along side edges for engaging the plastic material in the priorly mentioned interference fit to support the terminals in the housing. The support of the terminals 52 and 53 in the plug is two-fold. First, since this plug 50 is destined for field assembly to a cord 41, the terminals 52 and 53 must be assembled to the plug in a manufacturing facility in a partially assembled stage. This temporary support must be sufficient to prevent the terminals 52 and 53 from inadvertent canting, laterally or longitudinally, or drop-out. Permanent support must also be provided for the terminals 52 and 53 when the terminals have been seated fully within the housing 51.

When all of the cord conductors are disposed in a planar array, such as, for example, the "flat" cords commonly manufactured today, the terminal support functions may be satisfied by the edgewise configuration shown in U.S. Pat. No. 3,860,316 and in priorly-identified application Ser. No. 620,630. All the terminals in a plug used to terminate a flat cord are of the same height between the edge contact surfaces 144-144 and the conductor-engaging tangs 143-143. This height is sufficient to permit the use of side edge barbs shown in U.S. Pat. No. 3,860,316 in holding the terminals in the fully seated position. The barbs gouge away portions of the end walls of the terminal-receiving openings. The barbs generally provide local and, effectively only point, support with the plastic material which renders the terminal subject to some pivotal movement. This arrangement is not suitable for arming plugs with terminals since there is not adequate support to maintain the terminals in accurate alignment for engagement with tooling (not shown) which is destined to drive the terminals into fully seated positions.

The housing 51 having the two tiers of conductor-receiving cells 72 and 73 raises new problems when attempting to provide temporary and permanent support for the terminals 52 and 53. The different height terminals 52 and 53 are used in order to extend from a same external plane to different level internal planes represented by the surfaces 77 and 82 of the cells 72 and 73. Typically, the terminals 53 and 52 have overall heights of about 0.212 inch and about 0.140 inch, respectively.

The terminals 52 and 53 which are constructed in accordance with this invention overcome these problems and are provided with continuous support in engagement with the end walls 136 and 137, along generally the entire lengths of their oppositely disposed edge surfaces.

Figure 8B:
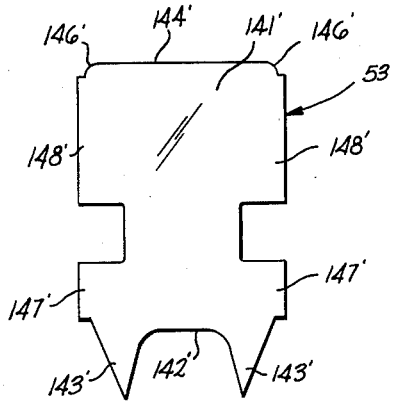
FIGS. 8A and 8B are elevational views of the terminals.
Figure 8A:
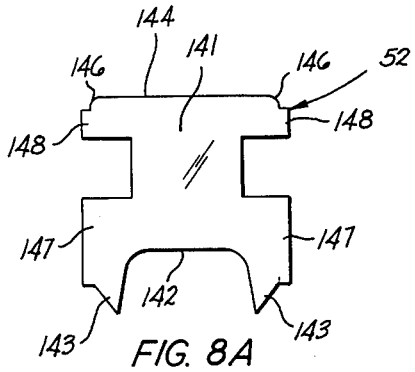

Viewing again FIGS. 8A and 8B it can be seen that the terminal 52 is formed with a side surface 147 adjacent to tangs 143 having a length, i.e. 0.055 inch which is substantially longer than the length of a side surface 148, i.e, 0.019 inch, adjacent the crown 146. On the other hand, the terminal 53 has a side surface 147' adjacent a tang 143' having a length, i.e. 0.035 inch, which is substantially shorter than the length, i.e. 0.078 inch, of a side surface 148' adjacent a crown 146'.

Because of the requirements of reduced height of the smaller terminal 52 and adequate support for the terminal in the armed position, it was found necessary to maximize the lengths of the side surfaces 147-147 of the terminal 52 adjacent the tangs 143-143 which engage the end surfaces 136-136 of the terminal-receiving openings 132-132. In order to accomplish this, the terminals 52-52 destined to extend to the conductor-receiving cells 72-72 are designed with reduced size conductor-engaging portions to permit the edge surfaces 147-147 to extend as close as possible to the tips of the tangs 143-143. A comparison of FIGS. 8A and 8B reveals that the tang 143 of the terminal 52 is substantially smaller than the corresponding tang 143' of the terminal 53.

Figure 7:
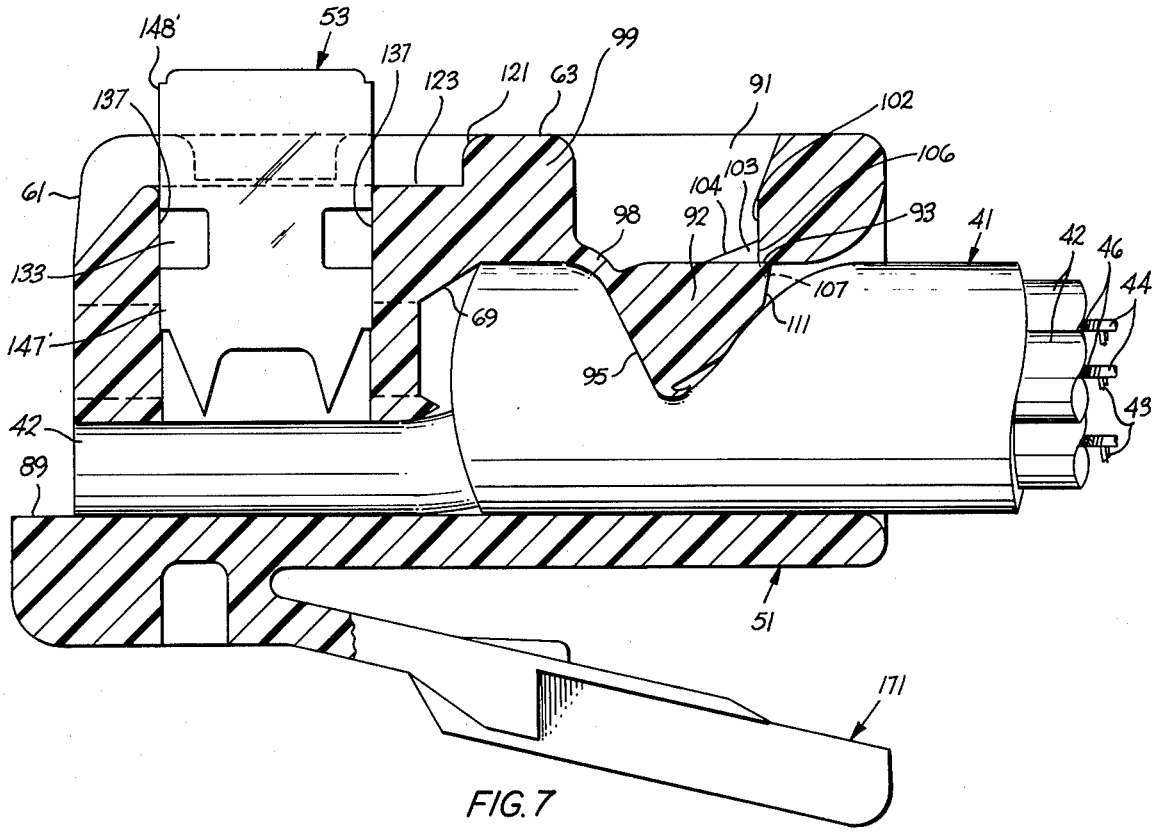
FIG. 7 is an enlarged elevational view in section of the plug showing the cord and another one of the terminals inserted partially.
Figure 11:
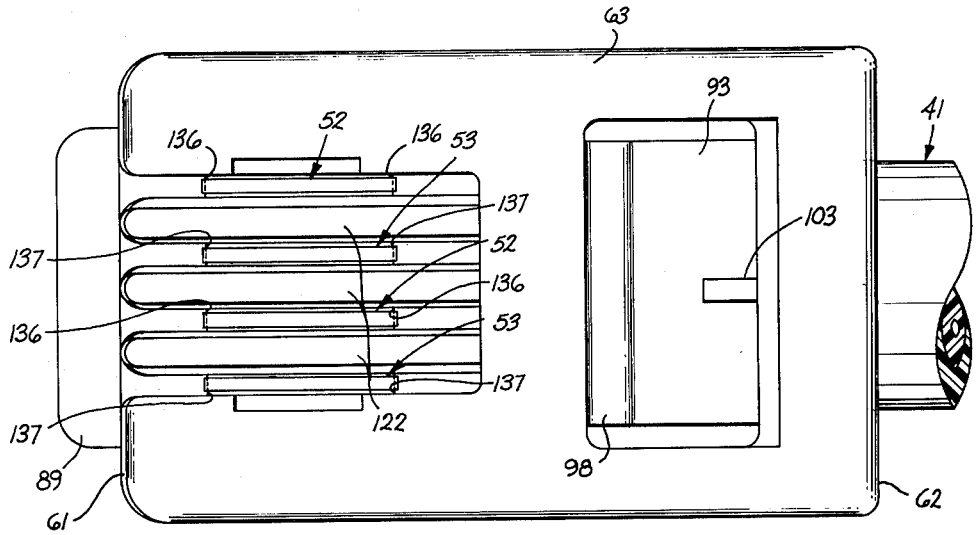
FIG. 11 is a plan view of the plug housing shown in FIG. 3 with the cord inserted thereinto and the terminals seated completely within the housing.
Figure 10:
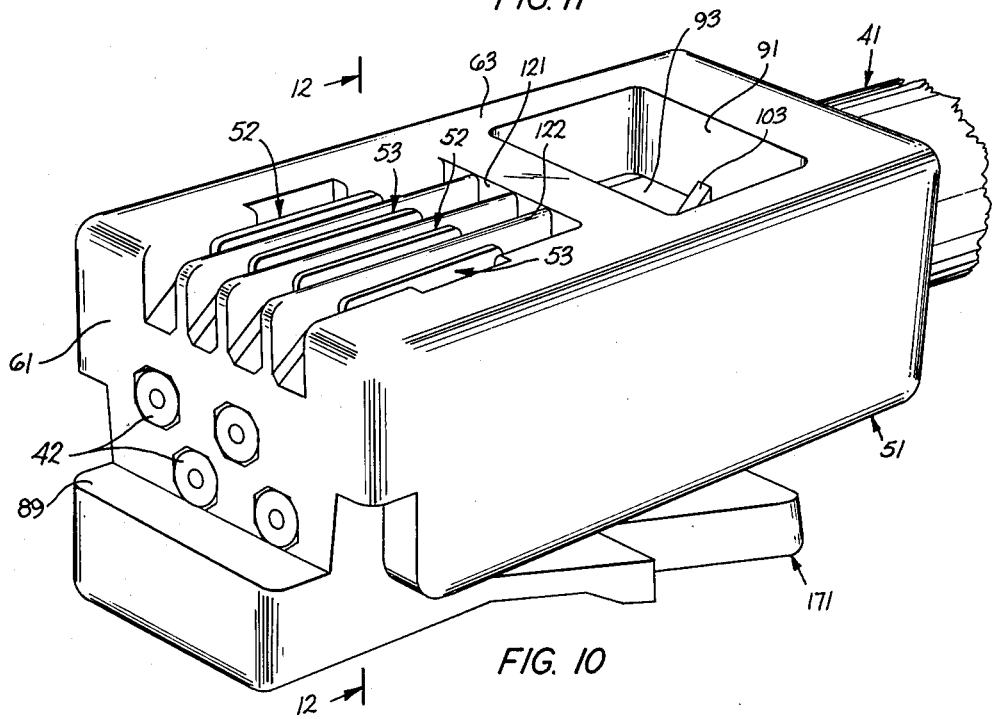
FIG. 10 is a perspective view of the plug shown in FIG. 3 with terminals inserted completely.

One of the terminals 52 is seated partially in each of the terminal-receiving openings 132 (see FIG. 6), and one of the terminals 53 is seated partially within each of the openings 133 (see FIG. 7). The partial seating is accomplished to position each terminal 52 or 53 with the tangs 143 or 143' thereof slightly above the walls 76 and 81 of the associated cells 72 and 73, respectively (see FIG. 5).

Considering first the terminals 52-52 (see FIG. 6), the partial seating causes portions of the lower side surfaces 147 to be in engagement with end walls 136-136 of the terminal-receiving openings 132-132. Approximately 0.050 inch of the overall 0.140 inch height of the terminal 52 protrudes above the housing surface 63 and approximately 0.087 inch extends along the well surface 123.

Turning now to the partially seated terminals 53-53, (see FIG. 7) the full extent of side edge surfaces 147'-147' and portions of the surfaces 148'-148' are in engagement with the end walls 137-137 of the terminal-receiving openings 133-133. Portions of the side edge surfaces 148'-148' are spaced above the surface 63 of the housing 51 when the terminals 53-53 are supported in the temporary position. Approximately 0.050 inch of the overall height of the terminal 53 protrudes above the housing surface 63 and approximately 0.087 inch extends above the well surface 123.

Edge surfaces 147 and 148 of the terminal 52 and edge surfaces 147' and 148' of the terminal 53 are designed to cooperate with the end surfaces 136 and 137 of the terminal-receiving openings 132 and 133, respectively, of the housing 51 to support the terminals in both the temporary and final positions.

Figure 9:
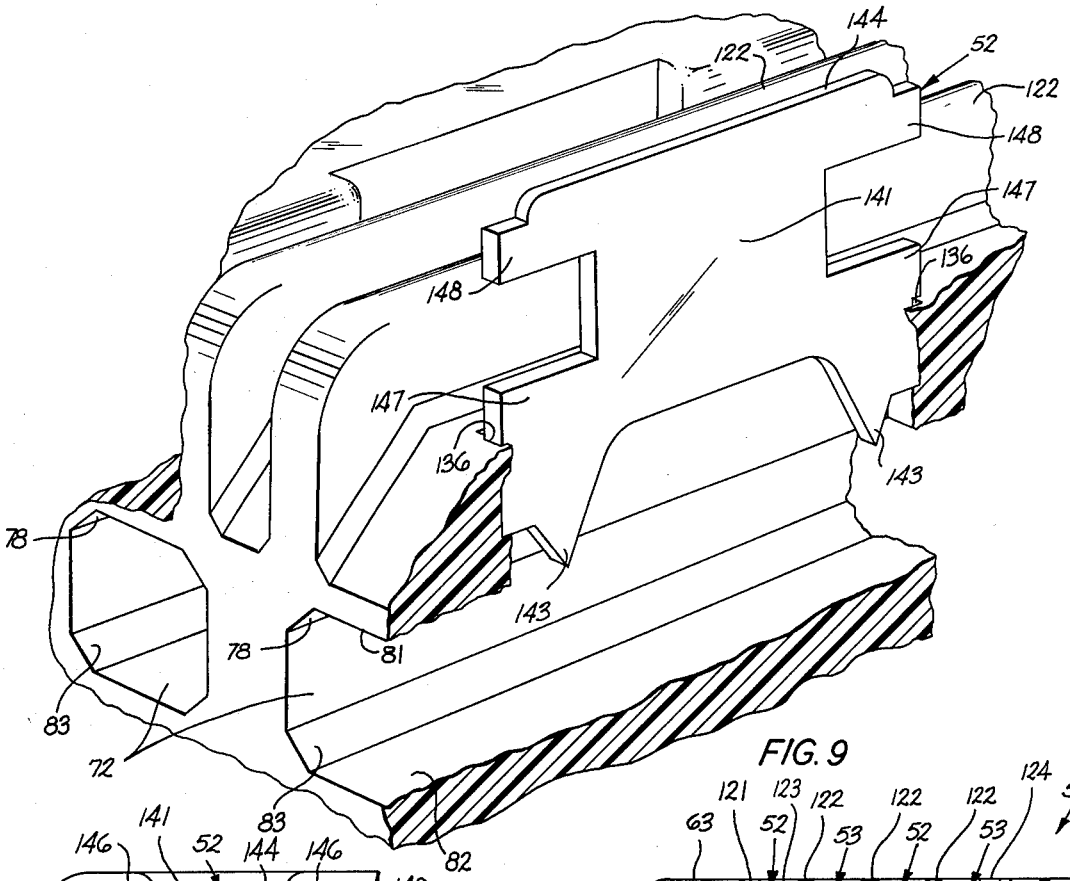
FIG. 9 is a detailed perspective view of a portion of the plug housing as shown in FIG. 6 and armed with one of the terminals.
Figure 13:
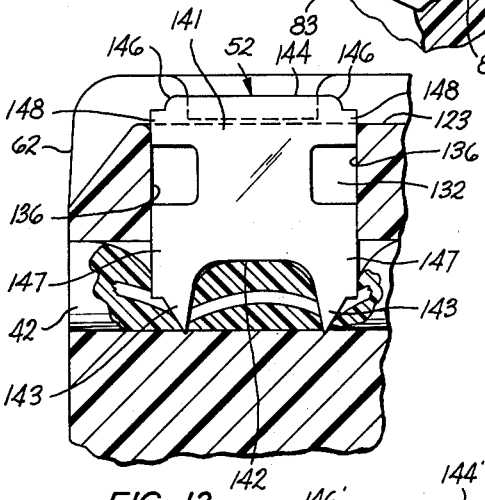
FIGS. 13 and 14 are enlarged detailed elevational views showing the support of the terminals in the housing in the fully seated position.
Figure 12:
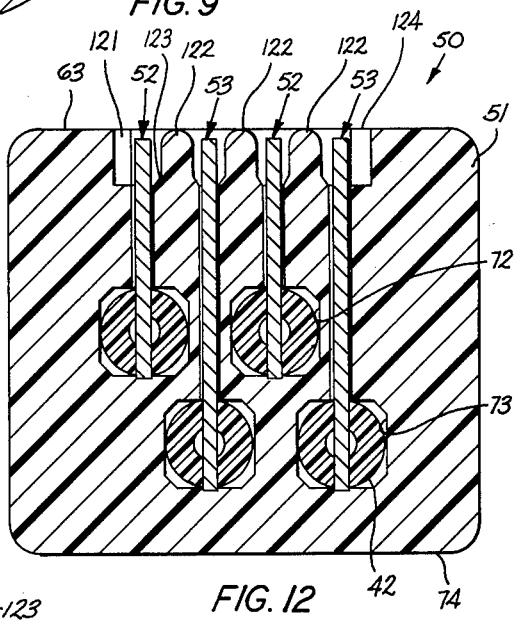
FIG. 12 is a sectional view of the plug of FIG. 10 with the terminals fully seated and taken along lines 12—12 thereof.
Figure 14:
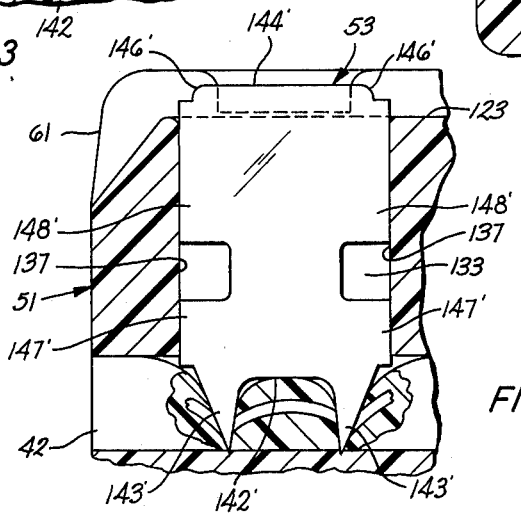

As can be observed from FIG. 9, the insertion of the terminals 52 and 53 into the terminal-receiving openings 132 and 133, respectively, causes the edge surfaces 147 and 148 and the edge surfaces 147' and 148' to deform the end surfaces 136 and 137 of the openings which may include partial shearing of the plastic. This results in the end walls 136 and 137 reforming generally into grooves, the walls of which are in clamping compressive engagement with the edge surfaces 147-147' and 148' and adjacent portions of the side surfaces 141-141' of the terminals. This arrangement advantageously provides a longer support surface for the terminals 52 and 53 than priorly constructed terminals having barbs formed on the sides thereof (see, for example, priorly identified U.S. Pat. No. 3,860,316) and is especially effective in preventing canting of the terminals in the slots.

In the refurbishing center an assembler terminates a refurbished circularly configured cord 41 with one of the partially completed plugs 50-50. The assembler removes the jacket 48 from an end portion of the cord 41 and inserts the conductors 42-42 into predetermined ones of the cells 72 and 73. Then the assembler inserts the jacketed end portion to abut the jacket 48 with the wall 69 (see FIG. 7) and operates tooling to move the jacket anchoring member 92 to the cord-engagement position. Next, excess lengths of the conductors 42-42 extending beyond the free end 61 of the housing 51 are trimmed with a tool (not shown).

At this time, the top edge surfaces 144 and 144' of the terminals 52 and 53, respectively, are disposed in one plane above the surface 63 of the housing 51 (see FIG. 5). This facilitates the use of tooling (not shown) to seat fully all of the terminals 52 and 53 simultaneously. The final step in the assembly of the plug 50 to the cord 41 is the seating fully of the terminals 52-52 and 53-53 in the housing 51 to establish electrical engagement with the conductors 42-42.

The completed seating of the terminals 52 and 53 is shown in FIGS. 10-14. Lower edge surfaces 147 and 147' of the terminals 52 and 53, respectively, engage the end surfaces 136 and 137 of the terminal-receiving openings 132 and 133. Portions of the upper edge surfaces 148-148 of the terminals 52-52 engage portions of the end surfaces of the terminal-receiving openings 132 (see FIG. 13) while substantially the entire lengths of the edge surfaces 148'-148' of the terminals 53 engage end surfaces of the terminal-receiving openings 133-133 (see FIG. 14).

The cooperation of the edge surfaces of the terminals 52 and 53 and the end surfaces 136 and 137 of the terminal-receiving openings 132 and 133 provides suitable support for the terminals in both the temporary, armed, and fully seated positions. Moreover, this arrangement allows the terminals 52 and 53 to be moved into fully seated positions without unduly distorting the plug housing 51.

The plug 50 also includes provisions for locking the plug within a jack 38. These provisions include a resilient locking tab 171 (see FIGS. 2 and 6). The description of the tab 171 and its operation are as disclosed in priorly identified U.S. Pat. No. 3,860,316, incorporated by reference hereinto.

While this invention has been described with reference to a unipartite housing 51, the invention is not so limited. It would be within the scope of this invention to construct a two piece plug such as that shown in priorly identified U.S. Pat. Nos. 3,699,498 and 3,769,867 to include provisions for assembling these plugs to "round" cords.

It is to be understood that the above-described arrangements are simply illustrative of the invention. Other arrangements may be devised by those skilled in the art which will embody the principles of the invention and fall within the spirit and scope thereof.

What is claimed is:

1. A device for making an electrical connection with a cord, which includes a plurality of insulated conductors, and with components external to the device, which comprises:

a dielectric housing which includes a plurality of conductor-receiving cells disposed in at least two tiers and a plurality of terminal-receiving openings associated with the cells, each of the openings including a slot extending generally parallel of and communicating with the associated cell, the length of each slot being exposed to an exterior surface of the device; and an electrically conductive terminal, seated within each of the terminal-receiving openings and formed to include:

an internal contact portion extending into the associated cell for piercing the insulation of and making electrical engagement with the conductor in the cell;

an external contact portion having an edge surface for making electrical engagement with a component external to the housing to establish an electrical connection with the component; and oppositely disposed edge surfaces in compressive engagement with walls of the housing which define the terminal-receiving openings to support the terminals against unintended movement.

2. The device of claim 1, wherein the slot of each terminal-receiving opening communicates with the associated conductor-receiving cell through an opening in a wall of the cell which is parallel to and adjacent the exterior surface of the housing to which the slot is exposed.

3. The device of claim 1, wherein the internal contact portions of the terminals include tangs which engage electrically a conductor in the cell associated with the terminal-receiving opening into which the terminal is inserted.

4. The device of claim 1, wherein the housing includes a terminal-receiving side with a well opening to the terminal-receiving side and the slots opening to the well, the housing further including a plurality of fins, each of the fins being disposed between and extending parallel of two adjacent slots, the fins extending from an interior surface of the well to which the slots open to a plane which includes the terminal-receiving side of the housing.

5. The device of claim 1, wherein the housing includes a free end and a cord-input end opposite to the free end, the conductor-receiving cells communicating with the cord-input end through a cavity.

6. The device of claim 5, wherein each of the conductor-receiving cells includes a laterally enclosed passageway which opens to the free end of the housing.

7. The device of claim 6, wherein an entrance end of each passageway adjacent the cavity is flared to facilitate insertion of a conductor thereinto.

8. The device of claim 1, wherein the oppositely disposed edge surfaces of each terminal are spaced apart a distance greater than the length of the terminal-receiving opening to provide an interference fit along generally the entire length of each of the oppositely disposed edge surfaces of the terminals with the walls of the housing which define the end surfaces of the associated terminal-receiving opening.

9. The device of claim 8, wherein the insertion of the terminals into the terminal-receiving openings cause the walls of the housing which define the end surfaces of the terminal-receiving openings adjacent the oppositely disposed edges of the terminals to be reformed into generally groove-like configurations which are in clamping engagement with the oppositely disposed end surfaces and adjacent side portions of each terminal.

10. A device armed with terminals for making an electrical connection with a cord, which includes a plurality of insulated conductors, and with components external to the device, which comprises:

a dielectric housing which includes a plurality of conductor-receiving cells disposed in at least two tiers and a plurality of terminal-receiving openings associated with the cells, each of the openings including a slot extending generally parallel of and communicating with the associated cell, the length of each slot being exposed at an exterior surface of the device; and a plurality of electrically conductive terminals, each having portions destined for internal and external electrical contact, one terminal seated partially within each of the terminal-receiving openings and destined to be seated completely subsequent to the assembly of the housing to a cord with a conductor received in each of the cells, the seating completely of the terminals causing the internal contact portions of each terminal to extend into the associated cell to engage electrically the conductor in the cell and causing the external contact portions to be disposed to engage components external to the housing, each terminal being formed along oppositely disposed edge surfaces to be in sufficient compressive engagement with portions of the dielectric housing which define the terminal-receiving opening, when the terminals is in the partially and the completely seated positions to prevent unintended movement of each terminal.

11. The device of claim 10, wherein the internal contact portions of the terminals include tangs which engage electrically a conductor in the cell associated with the terminal-receiving opening into which the terminal is inserted.

12. The device of claim 10, wherein the housing includes a free end and a cord-input end opposite to the free end, the conductor-receiving cells communicating with the cord-input end through a cavity.

13. The device of claim 12, wherein the slot of each terminal-receiving opening communicates with the associated conductor-receiving cell through that wall of the cell which is parallel to and adjacent the exterior surface of the housing to which the slot is exposed.

14. The device of claim 12, wherein each of the conductor-receiving cells includes a laterally enclosed passageway which opens to the free end of the housing.

15. The device of claim 14, wherein an entrance end of each passageway adjacent the cavity is flared to facilitate insertion of a conductor thereinto.

16. The device of claim 10, wherein generally the entire length of each of the oppositely disposed edge surfaces of each terminal is in an interference fit with the associated walls of the housing which define the associated terminal-receiving opening.

17. The device of claim 16, wherein the housing includes a terminal-receiving side with a well opening to the terminal receiving side and the slots opening to the well, the housing further including a plurality of fins, one of the fins being disposed between and extending parallel of two adjacent slots, the fins extending from an interior surface of the well to which the slots open to a plane which includes the terminal-receiving side of the housing.

18. The device of claim 16, wherein the insertion of the terminals into the terminal-receiving openings cause the walls of the housing which define the end surfaces of the terminal-receiving openings adjacent the oppositely disposed edges of the terminals to be reformed into generally groove-like configurations which are in clamping engagement with the oppositely disposed end surfaces and adjacent side portions of each terminal, each terminal having sufficient portions of the edge surfaces in engagement with the walls of the terminal-receiving openings to prevent unintended movement of the terminal.

19. A device for terminating a cord which includes:

a dielectric housing having a free end and which includes a plurality of conductor-receiving cells disposed in at least two tiers and a plurality of terminal-receiving openings associated with the cells each of the openings including a slot extending generally parallel of and communicating with the associated cell, the length of each slot being exposed to an exterior surface of the device, the housing including a well which opens to a terminal-receiving side of the housing, with a plurality of spaced fins extending from the surface to which the slots are exposed to a plane of the terminal-receiving side, further the housing being unipartite having one free end with internal surfaces of the housing defining a cord-input cavity that opens to the other end of the housing for receiving and substantially enclosing an end portion of a cord, the cord-input cavity communicating with the terminal-receiving side through an opening; and a pivotally moveable portion disposed within the opening of the housing which communicates the cord-input cavity with the terminal-receiving side and being disposed in an initial position and connected pivotally to the remainder of the housing toward the free end thereof, the pivotally connected portion having two intersecting externally facng surfaces, one of which has a stop formed thereon, the pivotally connected portion capable of being moved from the initial position to an actuated position at least partially into the cavity to clamp poritions of the cord inserted into the cavity, and with a portion of the one externally facing surface of the pivotally moveable portion engaging an inwardly facing surface of the cavity of the remainder of the housing adjacent the cord-input end of the housing and the stop engaging a wall of the opening adjacent the inwardly facing surface, the dual engagement of the one surface and of the stop with portions of the housing being effective to maintain the pivotally moveable portion in locked engagement with the cord during the application of retrograde forces to the cord.

20. A cord for making electrical connections which comprises:

a plurality of individually insulated conductors;

a plastic jacket enclosing the plurality of conductors;

a dielectric housing which includes a plurality of conductor-receiving cells disposed in at least two tiers and a plurality terminal-receiving openings associated with the cells, each of the openings including a slot extending generally parallel of and communicating with the associated cell, the length of each slot being exposed to an exterior surface of the device, the housing being connected at at least one end of the jacketed plurality of conductors such that each of the conductors is received in one of the cells; and an electrically conductive terminal, seated within each of the terminal-receiving openings and formed to include:

an internal contact portion extending into the associated cell for piercing the insulation of and making electrical engagement with the conductor in the cell;

an external contact portion having an edge surface for making electrical engagement with a component external to the housing to establish an electrical connection with the component; and oppositely disposed edge surfaces in compressive engagement with walls of the housing which define the terminal-receiving openings to support the terminals against unintended movement.

* * * * *